US009541318B2

(12) United States Patent
Matsuo et al.

(10) Patent No.: US 9,541,318 B2
(45) Date of Patent: Jan. 10, 2017

(54) ESTIMATION APPARATUS OF HEAT TRANSFER MEDIUM FLOW RATE, HEAT SOURCE MACHINE, AND ESTIMATION METHOD OF HEAT TRANSFER MEDIUM FLOW RATE

(75) Inventors: Minoru Matsuo, Tokyo (JP); Kenji Ueda, Tokyo (JP); Toshihiko Niinomi, Tokyo (JP); Hitoi Ono, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 490 days.

(21) Appl. No.: 13/824,215

(22) PCT Filed: Feb. 17, 2012

(86) PCT No.: PCT/JP2012/053802

§ 371 (c)(1),
(2), (4) Date: Mar. 15, 2013

(87) PCT Pub. No.: WO2012/132612

PCT Pub. Date: Oct. 4, 2012

(65) Prior Publication Data

US 2013/0174601 A1 Jul. 11, 2013

(30) Foreign Application Priority Data

Mar. 31, 2011 (JP) ..... 2011-081188

(51) Int. Cl.
*F25B 49/02* (2006.01)
*F04D 27/00* (2006.01)
(Continued)

(52) U.S. Cl.
CPC ..... *F25B 49/02* (2013.01); *F04D 27/001* (2013.01); *F04D 27/0246* (2013.01);
(Continued)

(58) Field of Classification Search
CPC ..... F25B 49/02; F25B 2400/0411; F25B 2500/19; F25B 2700/135; F25B 2400/23; F25B 2700/1351; F25B 41/043; F04D 27/0246; F04D 27/001
(Continued)

(56) References Cited

U.S. PATENT DOCUMENTS 3,082,951 A * 3/1963 Kayan ..... G06G 7/56 62/127
3,876,326 A * 4/1975 Weitz ..... F04D 27/0207 415/1
(Continued)

FOREIGN PATENT DOCUMENTS

CN 1629495 A 6/2005
DE 102009003978 A1 7/2010
(Continued)

OTHER PUBLICATIONS

Extended European Search Report dated Sep. 25, 2014, issued in corresponding European Application No. 12763681.9. (8 pages).
(Continued)

*Primary Examiner* — Emmanuel Duke
(74) *Attorney, Agent, or Firm* — Westerman, Hattori, Daniels & Adrian, LLP

(57) ABSTRACT

A flow rate of a heat transfer medium is computed without a flow meter. In a control apparatus (30), a storing portion (36) stores an aerodynamic characteristic map indicating a line causing a rotating stall and lines showing a sonic velocity in a refrigerant sucked in by a compressor (12) on a map displaying a variable θ reflecting a suction volume of the compressor (12) and a variable Ω reflecting a head of the compressor (12); a estimation portion of chilled water flow rate (30*b*) computes the variable Ω, derives the variable θ according to the variable Ω from the map, computes a heat amount exchanged between the refrigerant and the chilled
(Continued)

water in an evaporator (24) based on the suction volume of the compressor (12) according to the computed variable θ, and computes the flow rate of the chilled water based on the heat amount.

12 Claims, 3 Drawing Sheets

(51) Int. Cl.
*F04D 27/02* (2006.01)
*F25B 41/04* (2006.01)

(52) U.S. Cl.
CPC ..... *F25B 41/043* (2013.01); *F25B 2400/0411* (2013.01); *F25B 2400/23* (2013.01); *F25B 2500/19* (2013.01); *F25B 2700/135* (2013.01); *F25B 2700/1351* (2013.01)

(58) Field of Classification Search
USPC ..... 62/115, 157, 228.1
See application file for complete search history.

(56) References Cited

U.S. PATENT DOCUMENTS

| | | | | |
|---|---|---|---|---|
| 4,156,578 | A * | 5/1979 | Agar | F04D 27/001 415/1 |
| 5,873,257 | A | 2/1999 | Peterson | |
| 7,200,524 | B2 * | 4/2007 | Kang | G05B 9/02 702/179 |
| 2003/0010046 | A1 * | 1/2003 | Freund | F25B 49/02 62/222 |
| 2005/0144965 | A1 * | 7/2005 | Ueda | F04D 27/0261 62/228.1 |
| 2006/0144059 | A1 * | 7/2006 | Kang | F25B 49/005 62/129 |
| 2010/0024456 | A1 * | 2/2010 | Ueda | F04D 27/0269 62/228.1 |
| 2011/0132541 | A1 * | 6/2011 | Tandou | H01L 21/67109 156/345.27 |
| 2013/0167567 | A1 * | 7/2013 | Fukui | F24F 11/008 62/115 |

FOREIGN PATENT DOCUMENTS

| | | | |
|---|---|---|---|
| JP | 04-090462 | A | 3/1992 |
| JP | 07-091764 | A | 4/1995 |
| JP | 10-089783 | A | 4/1998 |
| JP | 3253190 | B2 | 2/2002 |
| JP | 2005-155973 | A | 6/2005 |
| JP | 2005-180267 | A | 7/2005 |
| JP | 2007-255818 | A | 10/2007 |
| JP | 2008-121451 | A | 5/2008 |
| JP | 2009-127950 | A | 6/2009 |
| JP | 4385738 | B2 | 12/2009 |
| JP | 2010-121629 | A | 6/2010 |
| JP | 2010-127494 | A | 6/2010 |
| JP | 2010-159751 | A | 7/2010 |

OTHER PUBLICATIONS

International Search Report of PCT/JP2012/053802, mailing date of May 22, 2012.
Chinese Office Action dated Jul. 3, 2014, issued in corresponding Chinese application 201280003087.7 w/English translation (25 pages).
Office Action dated Mar. 3, 2015, issued in corresponding Japanese Patent Application No. 2011-081188 with English translation (8 pages).
Chinese Notice of Allowance dated Feb. 3, 2015, issued in corresponding CN Patent Application No. 201280003087.7(2 pages). Explanation of relevance—"The Notice of Allowance has been received."
Decision to Grant a Patent dated Aug. 25, 2015, issued in counterpart Japanese Patent Application No. 2011-081188 (3 pages).

* cited by examiner

ESTIMATION APPARATUS OF HEAT TRANSFER MEDIUM FLOW RATE, HEAT SOURCE MACHINE, AND ESTIMATION METHOD OF HEAT TRANSFER MEDIUM FLOW RATE

TECHNICAL FIELD

The present invention relates to an estimation apparatus of heat transfer medium flow rate, a heat source machine and an estimation method of heat transfer medium flow rate.

BACKGROUND ART

To operate a heat source machine, for example, a chiller on the design values, it is necessary to manage a flow rate of a heat transfer medium (chilled water) flowing into an evaporator, but a flow meter for measuring the flow rate of the heat transfer medium may not be provided in the chiller because a flow meter for measuring a flow rate is expensive, and it is required to reduce the number of components and so on.

Therefore, as the technologies for measuring a flow rate, PTL 1 discloses the estimation system of cooling water flow rate in that a chilling load is computed based on measurement values of an outlet temperature of chilled water, an inlet temperature of the chilled water and a flow rate of the chilled water, a heat exchange coefficient is computed based on the inlet temperature of the chilled water and the chilling load, and a flow rate of a cooling water is derived from measurement values sent from a group of sensors and the heat exchange coefficient, and then output it.

PTL 2 describes the technology in that for a plurality of air conditioning machines, a plurality of differential pressure sensors are provided to measure a differential pressure between an inlet and an outlet of chilled and heated water in each of the plurality of air conditioning machines and a flow sensor is provided to measure the entire flow rate of the chilled and heated water, and by providing a flow path allowing only one differential pressure sensor to operate through valve switching and the like, the relation between the flow rate and the differential pressure is obtained before operation of cooling, and on the operation of cooling, a flow rate of the chilled and heated water is obtained using the differential pressure sensors.

CITATION LIST

Patent Literature

{PTL 1}
Japanese Unexamined Patent Application, Publication No. 7-91764
{PTL 2}
Japanese Unexamined Patent Application, Publication No. 2005-155973

SUMMARY OF INVENTION

Technical Problem

However, according to the technology described in PTL 1, the flow meter for measuring the flow rate of the chilled water is used to compute the flow rate of the cooling water. According to the technology described in PTL 2, to measure the flow rate of the chilled and heated water in each of air conditioning machines, the flow sensor for measuring the flow rate of all the chilled and heated water and the plurality of differential pressure sensors is used.

As described above, according to the technologies described in PTL 1 and PTL 2, because to compute a flow rate of a predetermined fluid, the flow meter for measuring a flow rate of the other fluid and the differential pressure gauge for measuring a differential pressure of the other fluid are used, the flow rate of the fluid cannot be figured out at low cost.

Therefore, the present invention has been made in view of the situations described above, and its object is to provide an estimation apparatus of heat transfer medium flow rate capable of computing a flow rate of a heat transfer medium without using a flow meter, a heat source machine, and an estimation method of heat transfer medium flow rate.

Solution to Problem

To solve the problem described above, an estimation apparatus of heat transfer medium flow rate, a heat source machine and an estimation method of heat transfer medium flow rate employ the following solutions.

That is, the estimation apparatus of heat transfer medium flow rate according to one aspect of the present invention is an estimation apparatus of heat transfer medium flow rate for estimating a flow rate of a heat transfer medium in the heat source machine including a compressor for compressing a refrigerant, a condenser for condensing the compressed refrigerant using a heat source medium, and an evaporator for evaporating the condensed refrigerant and carrying out heat exchange between the refrigerant and a heat transfer medium, the estimation apparatus of heat transfer medium flow rate including a storing portion for storing an aerodynamic characteristic map displaying a rotating stall line causing a rotating stall and a plurality of machine Mach number lines indicating a sonic velocity in the refrigerant sucked in by the compressor on a map displaying a first parameter reflecting a suction volume of the compressor and a second parameter reflecting a head of the compressor, a first parameter computation portion for computing the second parameter and deriving the first parameter according to the second parameter from the aerodynamic characteristic map, and a heat transfer medium flow rate computation portion for computing an amount of heat exchanged between the refrigerant and the heat transfer medium in the evaporator based on the suction volume of the compressor according to the first parameter derived by the first parameter computation portion, and computing a flow rate of the heat transfer medium based on the amount of the heat.

According to the above aspect, the estimation apparatus of heat transfer medium flow rate is the apparatus for estimating the flow rate of the heat transfer medium in the heat source machine including the compressor for compressing the refrigerant, and the condenser for condensing the compressed refrigerant using the heat source medium.

The storing portion provided in the estimation apparatus of heat transfer medium flow rate stores the aerodynamic characteristic map displaying the rotating stall line causing a rotating stall and the plurality of machine Mach number lines indicating a sonic velocity in the refrigerant sucked in by the compressor on the map displaying the first parameter reflecting the suction volume of the compressor and the second parameter reflecting the head of the compressor. The aerodynamic characteristic map is to be prepared through a preliminary, detailed operating test of the compressor.

The second parameter and the machine Mach numbers have values corresponding to an operating state of the compressor, and the first parameter, that is, the suction volume of the compressor can be determined by computing the second parameter and the machine Mach numbers (sonic velocity in the refrigerant sucked in by the compressor) because the second parameter and the machine Mach numbers can allow the first parameter to be identified. The second parameter and the sonic velocity in the refrigerant can be derived from a pressure inside of the evaporator and a pressure inside of the condenser.

First, the first parameter computation portion computes the second parameter, and next, the first parameter according to the second parameter is derived from the aerodynamic characteristic map.

The heat transfer medium flow rate computation portion computes the amount of the heat exchanged between the refrigerant and the heat transfer medium in the evaporator based on the suction volume of the compressor according to the first parameter derived by the first parameter computation portion, and the flow rate of the heat transfer medium is computed based on the amount of the heat. That is, the heat transfer medium flow rate computation portion derives the flow rate of the heat transfer medium from a thermal balance between the refrigerant and the heat transfer medium in the evaporator.

In this way, using the suction volume of the compressor computed based on the aerodynamic characteristic map, the amount of the heat exchanged in the evaporator is computed and the flow rate of the heat transfer medium is derived from the amount of the heat, and accordingly the flow rate of the heat transfer medium can be computed without using a flow meter.

In the estimation apparatus of heat transfer medium flow rate described above, the heat transfer medium flow rate computation portion may derive: the flow rate of the refrigerant flowing in the evaporator from the suction volume of the compressor based on the first parameter derived by the first parameter computation portion and density of the refrigerant sucked into the compressor; the amount of the heat exchanged between the refrigerant and the heat transfer medium in the evaporator from the computed flow rate of the refrigerant and a difference between enthalpy on the inlet side and enthalpy on the outlet side of the evaporator; and the flow rate of the heat transfer medium based on the derived amount of the heat and a difference between temperature of the heat transfer medium flowing into the evaporator and temperature thereof flowing out of the evaporator.

In this manner, using the measurement result by a measuring instrument for measuring the pressure and temperature of the refrigerant and the heat transfer medium and the like can allow the flow rate of the heat transfer medium to be easily computed.

The estimation apparatus of heat transfer medium flow rate described above may be configured so that a number of revolutions of the compressor can be controlled, the storing portion stores a plurality of aerodynamic characteristic maps that differ according to the number of revolutions of the compressor, and the first parameter computation portion derives the first parameter according to the second parameter from the aerodynamic characteristic map corresponding to the number of revolutions of the compressor.

In this way, the first parameter according to the second parameter is derived from the aerodynamic characteristic map corresponding to the number of revolutions of the compressor, and accordingly the flow rate of the heat transfer medium can be computed with a higher accuracy.

In the estimation apparatus of heat transfer medium flow rate described above, the compressor may include a vane for adjusting the flow rate of the refrigerant at an inlet of the refrigerant, so that the storing portion may store a plurality of aerodynamic characteristic maps that differ according to a degree of opening of the vane, and the first parameter computation portion may derive the first parameter according to the second parameter from the aerodynamic characteristic map corresponding to the degree of opening of the vane.

In such a manner, the first parameter according to the second parameter is derived from the aerodynamic characteristic map corresponding to the degree of opening of the vane provided at the inlet of the refrigerant in the compressor, and accordingly the flow rate of the heat transfer medium can be computed with a higher accuracy.

In the estimation apparatus of heat transfer medium flow rate described above, between the condenser and the evaporator, a bypass pipe arrangement may be provided to allow the refrigerant in the condenser to flow into the evaporator, and to adjust the flow rate of the refrigerant flowing in the bypass pipe arrangement, a valve may be provided, so that the storing portion may store a plurality of aerodynamic characteristic maps that differ according to the degree of opening of the valve, and accordingly the first parameter computation portion may derive the first parameter according to the second parameter from the aerodynamic characteristic map corresponding to the degree of opening of the valve.

In this way, the first parameter according to the second parameter is derived from the aerodynamic characteristic map corresponding to the degree of opening of the valve provided in the bypass pipe arrangement for connecting the condenser with the evaporator, and accordingly the flow rate of the heat transfer medium can be computed with a higher accuracy.

The heat source machine according to one aspect of the present invention includes a compressor for compressing a refrigerant, a condenser for condensing the compressed refrigerant using a heat source medium, an evaporator for evaporating the condensed refrigerant and carrying out heat exchange between the refrigerant and a heat transfer medium, and any of the estimation apparatuses of heat transfer medium flow rate described above.

The estimation method of heat transfer medium flow rate according to one aspect of the present invention is an estimation method of heat transfer medium flow rate for estimating a flow rate of a heat transfer medium in a heat source machine including a compressor for compressing a refrigerant, a condenser for condensing the compressed refrigerant using a heat source medium and an evaporator for evaporating the condensed refrigerant and carrying out heat exchange between the refrigerant and a heat transfer medium, the estimation method of heat transfer medium flow rate including: a first stage in which a storing portion preliminarily stores an aerodynamic characteristic map displaying a rotating stall line causing a rotating stall and a plurality of machine Mach number lines indicating a sonic velocity in the refrigerant sucked in by the compressor on a map displaying a first parameter reflecting a suction volume of the compressor and a second parameter reflecting a head of the compressor, and by computing the second parameter, the first parameter according to the second parameter is derived from the aerodynamic characteristic map; and a second stage in which an amount of heat exchanged between the refrigerant and the heat transfer medium in the evaporator is computed based on the suction volume of the compressor according to the first parameter derived in the first stage, and a flow rate of the heat transfer medium is computed based on the amount of the heat.

Advantageous Effects of Invention

According to the present invention, a superior effect can be provided that the flow rate of the heat transfer medium can be computed without using a flow meter.

DESCRIPTION OF EMBODIMENTS

One embodiment of an estimation apparatus of heat transfer medium flow rate, a heat source machine and an estimation method of heat transfer medium flow rate according to the present invention will be described below with reference to the drawings.

First Embodiment

Hereinafter, a first embodiment of the present invention will be described.

Figure 1:
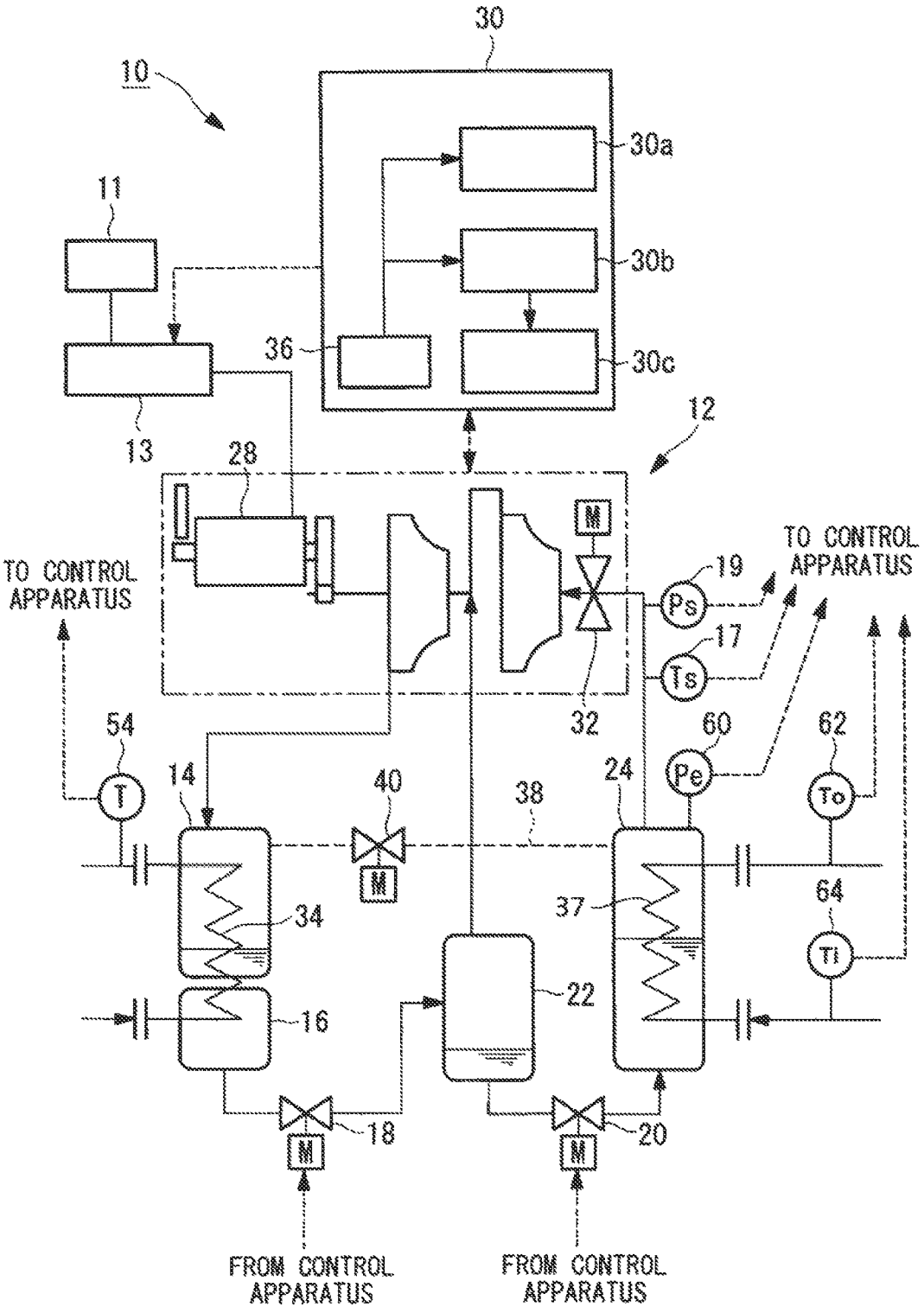
FIG. 1 is a schematic view illustrating a configuration of a centrifugal chiller including a compressor according to a first embodiment of the present invention.

FIG. 1 illustrates a configuration of a centrifugal chiller 10 that is one example of the heat source machine according to the first embodiment.

The centrifugal chiller 10 includes a compressor 12 for compressing a refrigerant, a condenser 14 for condensing a high temperature and pressure gas refrigerant that is compressed by the compressor 12 using a heat source medium (cooling water), a sub-cooler 16 for supercooling a refrigerant in a liquid phase (liquid refrigerant) that is condensed by the condenser 14, a high pressure expansion valve 18 for expanding the liquid refrigerant from the sub-cooler 16, an intercooler 22 connected to the high pressure expansion valve 18, and connected to an intermediate stage of the compressor 12 and a low pressure expansion valve 20, and an evaporator 24 for evaporating the liquid refrigerant expanded by the low pressure expansion valve 20 and carrying out heat exchange between the refrigerant and a heat transfer medium (chilled water).

The compressor 12 is a two-stage, centrifugal compressor, and driven by an electric motor 28 whose number of revolutions is controlled by an inverter 13, which changes an input frequency from a power supply 11. At a refrigerant intake of the compressor 12, an inlet vane (IGV) 32 is provided to control a flow rate of the refrigerant sucked in, and accordingly a volume of the compressor 12 can be controlled. Also, the compressor 12 includes a suction temperature sensor 17 for measuring a temperature of the refrigerant sucked in (hereinafter, called a "compressor suction temperature Ts"), and a suction pressure sensor 19 for measuring a pressure of the refrigerant sucked in (hereinafter, called a "compressor suction pressure Ps"). Outputs from the suction temperature sensor 17 and the suction pressure sensor 19 are input to a control apparatus 30.

The sub-cooler 16 is provided downstream of a refrigerant flow of the condenser 14 so as to supercool the condensed refrigerant.

Through the condenser 14 and the sub-cooler 16, a cooling heat-exchanger tube 34 is inserted. At an outlet of a cooling water of the cooling heat-exchanger tube 34 (outlet of a heated water), a heated water outlet temperature sensor 54 is provided. An output of the heated water outlet temperature sensor 54 is input to the control apparatus 30.

The evaporator 24, which is a heat exchanger, includes a pressure sensor 60 for measuring an evaporator pressure Pe that is a pressure inside of the evaporator 24. An output of this pressure sensor 60 is input to the control apparatus 30. Absorption of heat in the evaporator 24 can provide the refrigerant at a rated temperature (for example, 7° C.). Through the evaporator 24, a chilled water heat-exchanger tube 37 is inserted to cool the chilled water supplied to an external load. The chilled water heat-exchanger tube 37 situated upstream of the evaporator 24 includes a chilled water inlet temperature sensor 64 provided to measure an inlet temperature Ti of the chilled water flowing into the evaporator 24. A chilled water outlet nozzle situated downstream of the evaporator 24 includes a chilled water outlet temperature sensor 62 for measuring an outlet temperature To of the chilled water flowing out of the evaporator 24. Outputs of the chilled water inlet temperature sensor 64 and the chilled water outlet temperature sensor 62 are input to the control apparatus 30.

Between a gas phase portion of the condenser 14 and a gas phase portion of the evaporator 24, a hot gas bypass (hereinafter, called "HGBP") pipe arrangement 38 is provided. In the HGBP pipe arrangement 38, an HGBP valve 40 is provided to control a flow rate of the refrigerant flowing in the HGBP pipe arrangement 38. Adjustment of the HGBP flow rate by the HGBP valve 40 can allow a volume to be controlled in a very small load that the inlet vane 32 cannot control sufficiently.

The control apparatus 30 controls the entire centrifugal chiller 10, and includes a control portion of number of revolutions 30*a*, an estimation portion of chilled water flow rate 30*b*, and a control portion of degree of opening of expansion valve 30*c*.

The control portion of number of revolutions 30*a* outputs a directive frequency according to a directive number of revolutions of the electric motor 28 to the inverter 13 based on state quantities (for example, pressure and temperature) in each portion of the centrifugal chiller 10.

The estimation portion of chilled water flow rate 30*b* computes the flow rate of the chilled water, and outputs the computed result to the control portion of degree of opening of expansion valve 30*c*.

The control portion of degree of opening of expansion valve 30*c* generates a command value for a degree of opening of the expansion valves based on the state quantities (for example, pressure and temperature) in each portion of the centrifugal chiller 10 and the flow rate of the chilled water input from the estimation portion of chilled water flow rate 30*b*, and transmits the command value for the degree of opening of the expansion valves to the high pressure expansion valve 18 and the low pressure expansion valve 20, thus controlling a degree of opening of the high pressure expansion valve 18 and the low pressure expansion valve 20.

The control apparatus 30 also controls any kinds of apparatuses necessary for controlling the centrifugal chiller 10, such as the inlet vane 32 for a degree of opening and the HGBP valve 40 for a degree of opening.

Cooling capacity Q of the centrifugal chiller 10 is obtained based on the inlet temperature Ti and the outlet temperature To of the chilled water flowing in the evaporator 24 and the flow rate Gw of the chilled water. In particular, as the following equation (1) shows, the cooling capacity Q is obtained by multiplying a difference (Ti−To) between the temperature at the outlet and the temperature at the inlet of the chilled water by the flow rate Gw {kg/s} of the chilled water and specific heat cp {kJ/(kg·° C.)} of the chilled water.

$$Q=(Ti-To)\cdot Gw\cdot cp \tag{1}$$

Based on this cooling capacity Q and a difference Δh between enthalpy of the refrigerant gas at the outlet and enthalpy thereof at the inlet of the compressor 12, according to the following equation (2), a flow rate Ge of the refrigerant of the evaporator, which is a flow rate of the refrigerant flowing in the evaporator 24, is obtained.

$$Ge = k \cdot \frac{Q}{\Delta h} \tag{2}$$

where k is a constant.

Based on the flow rate Ge of the refrigerant of the evaporator, specific volume V (Te) {$m^3$/kg} of a saturated gas, an outer diameter D {m} of the impeller of the compressor 12, and a sonic velocity a (Te) {m/s} in the suction refrigerant at a saturation temperature Te derived from the evaporator pressure Pe, according to the following equation (3), a flow rate variable θ is obtained. This flow rate variable is a dimensionless number reflecting the suction volume of the compressor 12.

$$\theta = \frac{Ge \cdot V(Te)}{a(Te) \cdot D^2} \tag{3}$$

In this way, the flow rate variable θ is derived from the cooling capacity Q and the evaporator pressure Pe.

A pressure variable Ω is a dimensionless number reflecting the head of the compressor 12, and derived, according to the following equation (4), from a difference Δh (Te) in enthalpy of the refrigerant gas obtained from a condenser pressure Pc, an evaporator pressure Pe and a saturation temperature Te computed from the evaporator pressure Pe, and a sonic velocity a (Te) in the suction refrigerant at a saturation temperature Te computed from the evaporator pressure Pe of the evaporator 24.

$$\Omega = \frac{\Delta h(Te)}{a(Te)^2} \tag{4}$$

In this way, the pressure variable Ω is derived from the condenser pressure Pc and the evaporator pressure Pe, and obtained independently of a circumferential velocity of the impeller.

Based on the flow rate variable θ and the pressure variable Ω described above, a present, operational state of the compressor 12 can be estimated.

Figure 2:
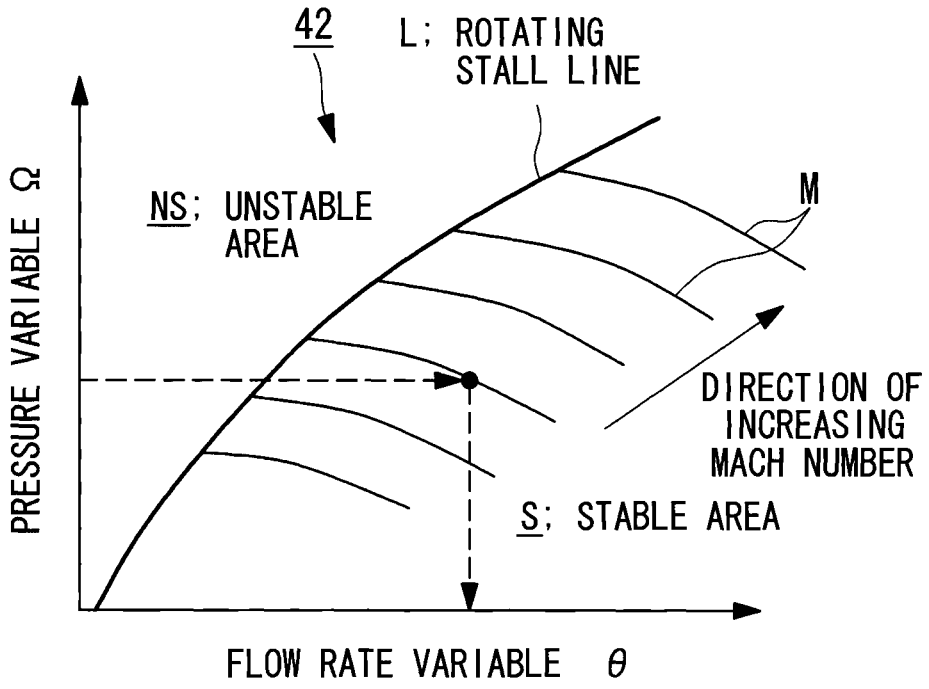
FIG. 2 is a graph illustrating an aerodynamic characteristic map according to the first embodiment of the present invention.

A storing portion 36 provided in the control apparatus 30 includes an aerodynamic characteristic map 42 of the compressor 12. This aerodynamic characteristic map 42 is to be prepared through a preliminary, detailed operating test of the compressor 12, and indicates a rotating stall line L causing a rotating stall of the compressor 12 on a map of the flow rate variable θ vs. the pressure variable Ω. For example, the aerodynamic characteristic map 42 as shown in FIG. 2 is obtained. In this aerodynamic characteristic map 42, an area below the rotating stall line L is considered as a stable area S that does not cause a rotating stall and a surging, and an area above the rotating stall line L is considered as an unstable area NS that causes a rotating stall and a surging. In this embodiment, this aerodynamic characteristic map 42 is a map when a degree of opening of the inlet vane 32 is set to 100%, i.e. the maximum degree of opening (a map at the maximum degree of opening).

The aerodynamic characteristic map 42 shows a plurality of machine Mach number lines M showing a machine Mach number (sonic velocity in the suction refrigerant that is a sonic velocity in the refrigerant sucked in by the compressor 12). Each of the machine Mach number lines shows a machine Mach number having the same value, and as it goes upward, the machine Mach number increases.

The flow rate variable θ is identified by the pressure variable Ω and the machine Mach number, and accordingly computation of the pressure variable Ω and the machine Mach number, that is, deformation of the flow rate variable θ, i.e. the equation (3) can allow the suction volume of the compressor 12 to be computed.

Because a flow sensor for measuring a flow rate is expensive and the number of components is reduced and so on, the centrifugal chiller 10 according to the first embodiment does not include the flow sensor for measuring the flow rate of the chilled water and the cooling water. However, to operate the chiller on the design values, it is necessary to manage the flow rate of the chilled water.

The centrifugal chiller 10 according to the first embodiment carries out an estimation processing of chilled water flow rate in which the pressure variable Ω is computed, the flow rate variable θ according to the pressure variable Ω is derived from the aerodynamic characteristic map, the amount of the heat exchanged between the refrigerant and the chilled water in the evaporator 24 is computed based on the suction volume of the compressor 12 according to the computed flow rate variable θ, and the flow rate of the chilled water is computed based on the amount of the heat.

That is, in the estimation processing of chilled water flow rate, the flow rate variable θ corresponding to the operational state of the compressor 12 is computed, and the flow rate of the chilled water, using the amount of the heat based on the suction volume of the compressor 12 derived from the flow rate variable θ, is derived from a thermal balance between the refrigerant and the chilled water in the evaporator 24.

Figure 3:
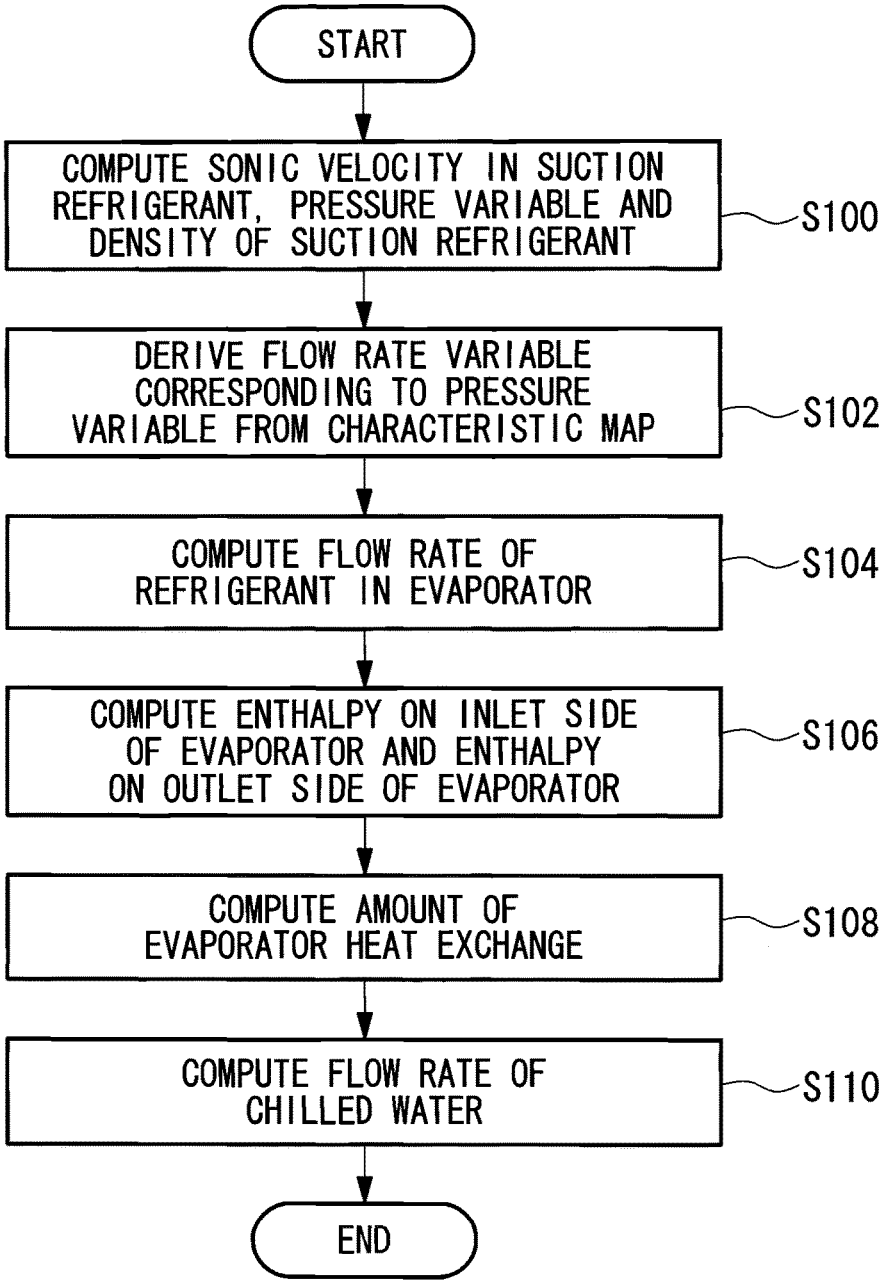
FIG. 3 is a flowchart illustrating a processing flow of chilled water flow rate estimation program according to the first embodiment of the present invention.

FIG. 3 is a flowchart illustrating a processing flow of chilled water flow rate estimation program executed by the estimation portion of chilled water flow rate **30*b* provided in the control apparatus 30 when the estimation processing of chilled water flow rate is executed, and a chilled water flow rate estimation program is preliminarily stored in a predetermined area of a storing portion provided in the estimation portion of chilled water flow rate 30*b***. This program is executed, for example, at a predetermined time interval.

At the step 100, the sonic velocity a (Te) in the suction refrigerant, the pressure variable Ω, and the density ρ of the suction refrigerant are computed.

The sonic velocity a (Te) in the suction refrigerant, as described above, is computed based on the saturation temperature Te derived from the evaporator pressure Pe, and the pressure variable Ω is computed according to the equation (4). The density ρ of the suction refrigerant is derived from the compressor suction temperature Ts measured by the suction temperature sensor 17 provided in the compressor 12 and the compressor suction pressure Ps measured by the suction pressure sensor 19.

At the next step 102, the flow rate variable θ corresponding to the computed pressure variable Ω and sonic velocity a (Te) in the suction refrigerant is derived from the aerodynamic characteristic map 42. That is, the step 100 and the step 102 compute the flow rate variable θ corresponding to an operational state of the compressor 12.

At the next step 104, the flow rate Ge of the refrigerant in the evaporator is computed according to the following equation (5).

$$Ge=\rho\cdot Qs \tag{5}$$

where Qs is the suction volume $\{m^3/s\}$ of the compressor 12.

The suction volume Qs is computed according to the following equation (6) using the flow rate variable θ computed at the step 102. The following equation (6) is obtained by deforming the equation (3) to compute the suction volume Qs, and the sonic velocity a (Te) in the suction refrigerant is computed at the step 100, and the outer diameter D of the impeller of the compressor 12 is derived from the design values of the compressor 12.

$$Qs=Ge\cdot V(Te)=a(Te)\cdot D^2\cdot\theta \tag{6}$$

At the next step 106, the enthalpy hei on the inlet side of the evaporator 24 and the enthalpy heo on the outlet side of the evaporator 24 are computed.

At the next step 108, the amount of evaporator heat exchange Qe {kW(=kJ/sec)} that is an amount of heat exchanged between the chilled water and the refrigerant in the evaporator 24 is computed according to the following equation (7).

$$Qe=Ge\cdot(heo-hei) \tag{7}$$

At the next step 110, the flow rate Gw of the chilled water is computed, and the program ends.

$$Gw=\frac{Qe}{cp\cdot\rho w\cdot(Ti-To)} \tag{8}$$

In this way, according to the steps 104 to 110, the flow rate of the chilled water is derived from the thermal balance between the refrigerant and the chilled water in the evaporator 24.

The estimation portion of chilled water flow rate 30*b* outputs the computed flow rate Gw of the chilled water to the control portion of degree of opening of expansion valve 30*c*, and the control portion of degree of opening of expansion valve 30*c* generates a command value for the degree of opening of the expansion valve based on the state quantities (for example, pressure and temperature) of each portion of the centrifugal chiller 10 and the flow rate of the chilled water input from the estimation portion of chilled water flow rate 30*b*.

As described above, the control apparatus 30 according to the first embodiment includes the storing portion 36 for storing the aerodynamic characteristic map 42 showing the rotating stall line causing a rotating stall and the plurality of machine Mach number lines indicating a sonic velocity in the refrigerant sucked in by the compressor 12 on the map displaying the flow rate variable θ reflecting the suction volume of the compressor 12 and the pressure variable Ω reflecting the head of the compressor 12. And also the control apparatus 30, using the estimation portion of chilled water flow rate 30*b*, computes the pressure variable Ω, derives the flow rate variable θ according to the pressure variable Ω from the aerodynamic characteristic map 42, computes the amount of the heat exchanged between the refrigerant and the chilled water in the evaporator 24 based on the suction volume of the compressor 12 according to the computed flow rate variable θ, and computes the flow rate of the chilled water based on the amount of the heat.

Therefore, the control apparatus 30 according to the first embodiment can compute the flow rate of the chilled water without using a flow meter.

The estimation portion of chilled water flow rate 30*b* derives the flow rate of the refrigerant flowing in the evaporator 24 from the suction volume of the compressor 12 based on the computed flow rate variable θ and the density of the refrigerant sucked into the compressor 12, derives the amount of the heat exchanged between the refrigerant and the chilled water in the evaporator 24 from the computed flow rate of the refrigerant and the difference between the enthalpy on the inlet side and the enthalpy on the outlet side of the evaporator 24, and computes the flow rate of the chilled water based on the computed amount of the heat and the difference between the temperature of the chilled water flowing into the evaporator 24 and the temperature of the chilled water flowing out of the evaporator 24.

Therefore, the control apparatus 30 according to the first embodiment can easily compute the flow rate of the chilled water using the measurement result by the measuring instruments for measuring the pressure and temperature of the refrigerant and the chilled water, and the like.

Second Embodiment

A second embodiment of the present invention will be described below.

A configuration of the centrifugal chiller 10 according to the second embodiment is similar to that of the centrifugal chiller 10 according to the first embodiment shown in FIG. 1, and the description thereof will be omitted.

However, the storing portion 36 according to the second embodiment stores a plurality of aerodynamic characteristic maps 42 that differ according to a number of revolutions of the compressor 12 because the number of revolutions of the compressor 12 can be controlled by controlling a directive frequency sent to the electric motor 28 from the inverter 13.

The aerodynamic characteristic maps 42 according to the second embodiment indicate in such a manner that the flow rate variable relative to the same pressure variable becomes larger as the number of revolutions of the compressor 12 increases.

In the second embodiment, at the step 102 in the estimation program of chilled water flow rate, the aerodynamic characteristic map 42 corresponding to the number of revolutions of the compressor 12 (directive frequency) is selected from the storing portion 36, and the flow rate variable θ according to the pressure variable Ω is derived from the selected aerodynamic characteristic map 42.

As described above, because the control apparatus 30 according to the second embodiment derives the flow rate variable θ according to the pressure variable Ω from the aerodynamic characteristic map 42 corresponding to the number of revolutions of the compressor 12, the flow rate of the chilled water can be computed with a higher accuracy.

Third Embodiment

A third embodiment of the present invention will be hereinafter described.

A configuration of the centrifugal chiller 10 according to the third embodiment is similar to that of the centrifugal chiller 10 according to the first embodiment shown in FIG. 1, and the description thereof will be omitted.

However, because the centrifugal chiller 10 includes the inlet vane 32, the storing portion 36 according to the third embodiment stores a plurality of aerodynamic characteristic maps 42 that differ according to the degree of opening of the inlet vane 32.

The aerodynamic characteristic maps 42 according to the third embodiment indicate in such a way that the flow rate variable relative to the same pressure variable becomes larger as the degree of opening of the inlet vane 32 increases.

In the third embodiment, at the step 102 in the estimation program of chilled water flow rate, the aerodynamic characteristic map 42 corresponding to the degree of opening of the inlet vane 32 is selected from the storing portion 36, and the flow rate variable θ according to the pressure variable Ω is derived from the selected aerodynamic characteristic map 42.

As described above, because the control apparatus 30 according to the third embodiment derives the flow rate variable θ according to the pressure variable Ω from the aerodynamic characteristic map 42 corresponding to the degree of opening of the inlet vane 32, the flow rate of the chilled water can be computed with a higher accuracy.

Fourth Embodiment

A fourth embodiment of the present invention will be hereinafter described.

A configuration of the centrifugal chiller 10 according to the fourth embodiment is similar to that of the centrifugal chiller 10 according to the first embodiment shown in FIG. 1, and the description thereof will be omitted.

However, because the centrifugal chiller 10 includes the HGBP valve 40 in addition to the HGBP pipe arrangement 38, the storing portion 36 according to the fourth embodiment stores a plurality of aerodynamic characteristic maps 42 that differ according to the degree of opening of the HGBP valve 40.

The aerodynamic characteristic maps 42 according to the forth embodiment indicate in such a way that the flow rate variable relative to the same pressure variable becomes larger as the degree of opening of the HGBP valve 40 increases.

In the fourth embodiment, at the step 102 in the estimation program of chilled water flow rate, the aerodynamic characteristic map 42 corresponding to the degree of opening of the HGBP valve 40 is selected from the storing portion 36, and the flow rate variable θ according to the pressure variable Ω is derived from the selected aerodynamic characteristic map 42.

As described above, because the control apparatus 30 according to the fourth embodiment derives the flow rate variable θ according to the pressure variable Ω from the aerodynamic characteristic map 42 corresponding to the degree of opening of the HGBP valve 40, the flow rate of the chilled water can be computed with a higher accuracy.

As described above, the present invention has been described with reference to each of the embodiments, but the technical range of the present invention is not limited to the range described in the above embodiments. A variety of modifications or improvements may be made to each of the embodiments described above without departure from the spirit and range of the present invention, and embodiments in which the modifications or the improvements are made are intended also to fall within the technical range of the present invention.

In each of the above embodiments, the embodiment has been described in which the cooling water is used as the heat source medium flowing in the cooling heat-exchanger tube 34 inserted through the condenser 14, but the present invention is not limited to this embodiment, and an embodiment may be such that the heat source medium is a gas (external air) and the condenser is an air type heat exchanger.

In each of the above embodiments, the case where the present invention is applied to the centrifugal chiller 10 carrying out a cooling operation, but not limited to this, the present invention may be applied to a heat pump type centrifugal chiller also capable of carrying out a heat pump operation.

In each of the above embodiments, the embodiment has been described in which as the centrifugal chiller 10, a centrifugal compressor is used, but the present invention is not limited to this embodiment, and the present invention may be also applied to any other compression configurations, for example, a screw heat pump using a screw compressor.

Also, the processing flow of the estimation program of chilled water flow rate described in each of the above embodiments is one example, and an unnecessary step may be deleted, a new step may be added, and a processing flow may be changed without departure from the spirit and range of the present invention.

REFERENCE SIGNS LIST

10 centrifugal chiller
12 compressor
14 condenser
24 evaporator
32 inlet vane
30 control apparatus
**30*b*** estimation portion of chilled water flow rate
36 storing portion
38 HGBP pipe arrangement
40 HGBP valve

The invention claimed is:

1. An estimation apparatus of heat transfer medium flow rate for estimating a flow rate of a heat transfer medium in a heat source machine including: a variable-speed centrifugal compressor for sucking and compressing a refrigerant; a condenser for condensing the compressed refrigerant using a heat source medium; and an evaporator for evaporating the condensed refrigerant and carrying out heat exchange between the refrigerant and the heat transfer medium, the estimation apparatus of heat transfer medium flow rate comprising:

a storing portion for storing an aerodynamic characteristic map indicating a rotating stall line causing a rotating stall and a plurality of machine Mach number lines showing a sonic velocity in the refrigerant sucked in by the compressor on a map displaying a first parameter reflecting a suction volume of the compressor and a second parameter reflecting a head of the compressor;

a first parameter computation portion for computing the second parameter and deriving the first parameter according to the second parameter from the aerodynamic characteristic map; and a heat transfer medium flow rate computation portion for computing an amount of heat exchanged between the refrigerant and the heat transfer medium in the evaporator based on the suction volume of the compressor according to the first parameter derived by the first parameter computation portion and a density of the refrigerant sucked into the compressor, and computing a flow rate of the heat transfer medium based on the amount of the heat, wherein the storing portion stores a plurality of aerodynamic characteristic maps that differ according to the number of revolutions of the compressor, and the first parameter computation portion derives the first parameter according to the second parameter from the aerodynamic characteristic map corresponding to the number of revolutions of the compressor.

2. The estimation apparatus of heat transfer medium flow rate according to claim 1, wherein the heat transfer medium flow rate computation portion:

derives a flow rate of the refrigerant flowing in the evaporator from the suction volume of the compressor based on the first parameter derived by the first parameter computation portion and the density of the refrigerant sucked into the compressor;

derives the amount of the heat exchanged between the refrigerant and the heat transfer medium in the evaporator from the computed flow rate of the refrigerant and a difference between enthalpy on the inlet side and enthalpy on the outlet side of the evaporator, and computes the flow rate of the heat transfer medium based on the derived amount of the heat and a difference between temperature of the heat transfer medium flowing into the evaporator and temperature of the heat transfer medium flowing out of the evaporator.

3. The estimation apparatus of heat transfer medium flow rate according to claim 1, wherein the first parameter computation portion derives the first parameter from the second parameter and the machine Mach number lines.

4. A heat source machine, comprising:

a variable-speed centrifugal compressor for sucking and compressing a refrigerant;

a condenser for condensing the compressed refrigerant using a heat source medium, an evaporator for evaporating the condensed refrigerant and carrying out heat exchange between the refrigerant and a heat transfer medium, and the estimation apparatus of heat transfer medium flow rate according to claim 1.

5. The heat source machine according to claim 4, further comprising:

a temperature sensor for measuring a temperature of the refrigerant being sucked into the compressor; and a pressure sensor for measuring a pressure of the refrigerant being sucked into the compressor;

wherein the heat transfer medium flow rate computation portion computes a density of the refrigerant sucked into the compressor on the basis of the temperature measured by the temperature sensor and the pressure measured by the pressure sensor, computes an amount of heat exchanged between the refrigerant and the heat transfer medium in the evaporator on the basis of the density which is computed and the suction volume of the compressor according to the first parameter which is derived, and computes a flow rate of the heat transfer medium on the basis of the amount of the heat which is computed.

6. An estimation apparatus of heat transfer medium flow rate for estimating a flow rate of a heat transfer medium in a heat source machine including: a centrifugal compressor for sucking and compressing a refrigerant; a condenser for condensing the compressed refrigerant using a heat source medium; an evaporator for evaporating the condensed refrigerant and carrying out heat exchange between the refrigerant and the heat transfer medium, a bypass pipe arrangement provided between the condenser and the evaporator for flowing the refrigerant from the condenser to the evaporator, and a valve provided to adjust a flow rate of the refrigerant flowing in the bypass pipe arrangement, the estimation apparatus of heat transfer medium flow rate comprising:

a storing portion for storing an aerodynamic characteristic map indicating a rotating stall line causing a rotating stall and a plurality of machine Mach number lines showing a sonic velocity in the refrigerant sucked in by the compressor on a map displaying a first parameter reflecting a suction volume of the compressor and a second parameter reflecting a head of the compressor;

a first parameter computation portion for computing the second parameter and deriving the first parameter according to the second parameter from the aerodynamic characteristic map; and a heat transfer medium flow rate computation portion for computing an amount of heat exchanged between the refrigerant and the heat transfer medium in the evaporator based on the suction volume of the compressor according to the first parameter derived by the first parameter computation portion and a density of the refrigerant sucked into the compressor, and computing a flow rate of the heat transfer medium based on the amount of the heat, wherein the storing portion stores a plurality of the aerodynamic characteristic maps that differ according to the degree of opening of the valve, and the first parameter computation portion derives the first parameter according to the second parameter from the aerodynamic characteristic map corresponding to the degree of opening of the valve.

7. The estimation apparatus of heat transfer medium flow rate according to claim 6, wherein the heat transfer medium flow rate computation portion:

derives a flow rate of the refrigerant flowing in the evaporator from the suction volume of the compressor based on the first parameter derived by the first parameter computation portion and the density of the refrigerant sucked into the compressor;

derives the amount of the heat exchanged between the refrigerant and the heat transfer medium in the evaporator from the computed flow rate of the refrigerant and a difference between enthalpy on the inlet side and enthalpy on the outlet side of the evaporator, and computes the flow rate of the heat transfer medium based on the derived amount of the heat and a difference between temperature of the heat transfer medium flowing into the evaporator and temperature of the heat transfer medium flowing out of the evaporator.

8. The estimation apparatus of heat transfer medium flow rate according to claim 6, wherein the first parameter computation portion derives the first parameter from the second parameter and the machine Mach number lines.

9. A heat source machine, comprising:

a centrifugal compressor for sucking and compressing a refrigerant;

a condenser for condensing the compressed refrigerant using a heat source medium, an evaporator for evaporating the condensed refrigerant and carrying out heat exchange between the refrigerant and a heat transfer medium, a bypass pipe arrangement provided between the condenser and the evaporator for flowing the refrigerant from the condenser to the evaporator, a valve provided to adjust a flow rate of the refrigerant flowing in the bypass pipe arrangement, and the estimation apparatus of heat transfer medium flow rate according to claim 6.

10. The heat source machine according to claim 9, further comprising:

a temperature sensor for measuring a temperature of the refrigerant being sucked into the compressor; and a pressure sensor for measuring a pressure of the refrigerant being sucked into the compressor;

wherein the heat transfer medium flow rate computation portion computes a density of the refrigerant sucked into the compressor on the basis of the temperature measured by the temperature sensor and the pressure measured by the pressure sensor, computes an amount of heat exchanged between the refrigerant and the heat transfer medium in the evaporator on the basis of the density which is computed and the suction volume of the compressor according to the first parameter which is derived, and computes a flow rate of the heat transfer medium on the basis of the amount of the heat which is computed.

11. An estimation method of heat transfer medium flow rate for estimating a flow rate of a heat transfer medium in a heat source machine including: a variable-speed centrifugal compressor for sucking and compressing a refrigerant; a condenser for condensing the compressed refrigerant using a heat source medium; and an evaporator for evaporating the condensed refrigerant and carrying out heat exchange between the refrigerant and the heat transfer medium, the estimation method of heat transfer medium flow rate comprising:

a first stage, wherein a storing portion preliminarily stores an aerodynamic characteristic map indicating a rotating stall line causing a rotating stall and a plurality of machine Mach number lines showing a sonic velocity in the refrigerant sucked in by the compressor on a map displaying a first parameter reflecting a suction volume of the compressor and a second parameter reflecting a head of the compressor;

by computing the second parameter, the first parameter according to the second parameter is derived from the aerodynamic characteristic map; and a second stage, wherein the amount of heat exchanged between the refrigerant and the heat transfer medium in the evaporator is computed based on the suction volume of the compressor according to the first parameter derived by the first stage and a density of the refrigerant sucked into the compressor, and a flow rate of the heat transfer medium is computed based on the amount of the heat, wherein the storing portion stores a plurality of aerodynamic characteristic maps that differ according to the number of revolutions of the compressor, and the first parameter according to the second parameter is derived from the aerodynamic characteristic map corresponding to the number of revolutions of the compressor.

12. An estimation method of heat transfer medium flow rate for estimating a flow rate of a heat transfer medium in a heat source machine including: a centrifugal compressor for sucking and compressing a refrigerant; a condenser for condensing the compressed refrigerant using a heat source medium; an evaporator for evaporating the condensed refrigerant and carrying out heat exchange between the refrigerant and the heat transfer medium, a bypass pipe arrangement provided between the condenser and the evaporator for flowing the refrigerant from the condenser to the evaporator, and a valve provided to adjust a flow rate of the refrigerant flowing in the bypass pipe arrangement, the estimation method of heat transfer medium flow rate comprising:

a first stage, wherein a storing portion preliminarily stores an aerodynamic characteristic map indicating a rotating stall line causing a rotating stall and a plurality of machine Mach number lines showing a sonic velocity in the refrigerant sucked in by the compressor on a map displaying a first parameter reflecting a suction volume of the compressor and a second parameter reflecting a head of the compressor;

by computing the second parameter, the first parameter according to the second parameter is derived from the aerodynamic characteristic map; and a second stage, wherein the amount of heat exchanged between the refrigerant and the heat transfer medium in the evaporator is computed based on the suction volume of the compressor according to the first parameter derived by the first stage and a density of the refrigerant sucked into the compressor, and a flow rate of the heat transfer medium is computed based on the amount of the heat, wherein the storing portion stores a plurality of the aerodynamic characteristic maps that differ according to the degree of opening of the valve, and the first parameter according to the second parameter is derived from the aerodynamic characteristic map corresponding to the degree of opening of the valve.

* * * * *